United States Patent [19]

Foreman et al.

[11] 4,251,292

[45] Feb. 17, 1981

[54] METHOD FOR RESTORING MOLECULAR WEIGHT DISTRIBUTION OF A POLYMERIC QUENCHANT

[75] Inventors: Robert W. Foreman, Bloomfield Hills, Mich.; Anthony G. Meszaros, Windsor, Canada

[73] Assignee: Park Chemical Company, Detroit, Mich.

[21] Appl. No.: 57,915

[22] Filed: Jul. 16, 1979

Related U.S. Application Data

[63] Continuation-in-part of Ser. No. 909,074, May 24, 1978, abandoned.

[51] Int. Cl.[3] ..... C21D 1/46

[52] U.S. Cl. ..... 148/18; 148/20.6; 148/28; 148/143; 210/650

[58] Field of Search ..... 148/12.4, 18, 20.6, 148/143, 28; 210/23 F, 195.1–195.4, 321 R, 433 M

[56] References Cited

U.S. PATENT DOCUMENTS

| | | | |
|---|---|---|---|
| 3,663,403 | 5/1972 | Christenson et al. | 204/180 P |
| 3,956,114 | 5/1976 | Del Pico et al. | 210/23 F |
| 3,977,967 | 8/1976 | Trulson et al. | 210/23 F |
| 3,998,740 | 12/1976 | Bost et al. | 210/321 R |
| 4,087,290 | 5/1978 | Kopietz et al. | 148/20.6 |
| 4,090,891 | 5/1978 | Mitamura et al. | 148/28 |

*Primary Examiner*—L. Dewayne Rutledge
*Assistant Examiner*—John P. Sheehan
*Attorney, Agent, or Firm*—Krass & Young

[57] ABSTRACT

The subject invention provides a method and apparatus for the control and or rectification of molecular weight distribution of polymeric quenchants. In general this is accomplished by selective filtration and elimination of lower molecular weight constituents and the resulting restoration of the molecular weight balance which is necessary to maintain the quench of the desired severity.

2 Claims, 3 Drawing Figures

FIGURE-2
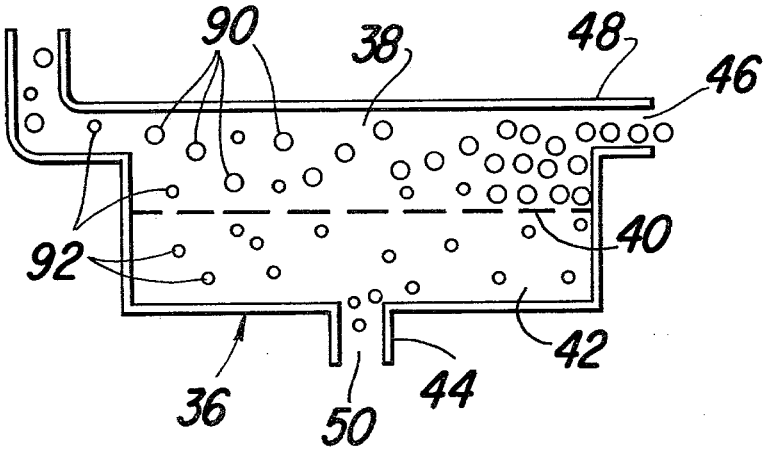
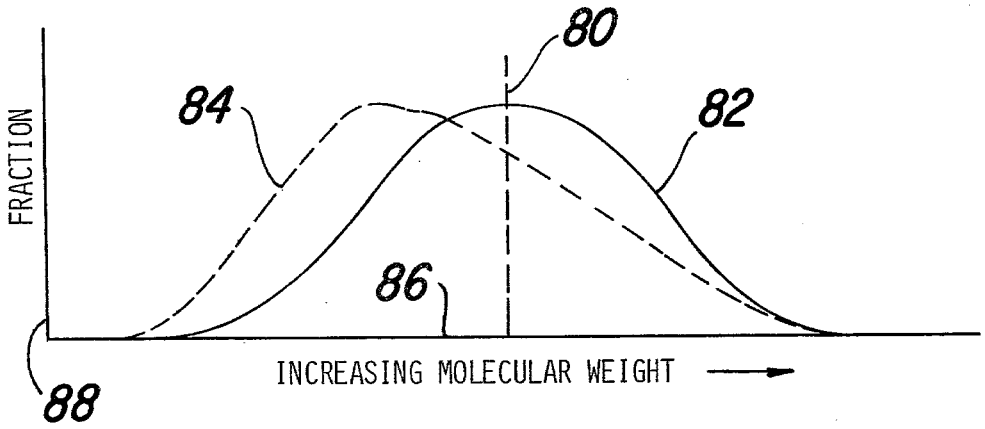
FIGURE 3

METHOD FOR RESTORING MOLECULAR WEIGHT DISTRIBUTION OF A POLYMERIC QUENCHANT

CROSS REFERENCE TO RELATED APPLICATION

This application is a continuation-in-part of Ser. No. 909,074 filed May 24, 1978, now abandoned.

BACKGROUND OF THE INVENTION

1. Field of the Invention

This invention relates to the restoration of aqueous solutions of polymers used as quenching baths. Quenching baths are used in the heat treatment and tempering of steels and other ferrous alloys.

2. Prior Art

One of the methods for heating treating steels and ferrous alloys consists of heating the metal to a relatively high temperature and then quenching or cooling the metal at a controlled rate. The rate of cooling is controlled by immersion in a liquid of controlled composition. Quenching oils and salt quenching baths are well known in the art. More recent on the scene have been quenchants which are aqueous solutions for example of polyvinyl alcohol, polyglycols or polyvinyl pyrrolidone.

With the polymeric quenchants one of the methods for controlling the quenching severity or rate of cooling is by varying the concentration of the polymer in the solution. That is, pure water conducts heat away from the hot metal being quenched very rapidly. As the concentration of the polymer increases the rate of heat removal by both conduction and convection slows. This is primarily the result of viscosity increase about the metal part and the increase in polymer deposition on the part being quenched as the concentration increases.

The polymer is added to the water in the quench bath to decrease the rate at which the heat is removed from the metal articles immersed in the bath. An increase in the concentration of the polymer causes a decrease in the rate of heat removal by convection and a decrease in the heat removal by conductivity in the solution.

This simple relationship, however, gets distorted during the use of the quenching bath. The cooled metal parts tend to preferentially drag out the higher molecular weight polymer molecules. Also as the heated metal enters the bath there is a certain amount of cracking of the higher molecular weight polymer molecules into fragments with lower molecular weights.

The preferential removal or cracking of larger molecular weight polymer molecules leads to skewing of the normal molecular weight distribution. The skew in the molecular weight distribution of the polymer can be observed using gel permeation chromatography. At a given concentration of polymer this skewing towards lower molecular weights results in a lower viscosity and a higher conductivity in the quench bath.

As a result of these effects accurate control of quench severity becomes difficult when a bath has been used for any significant period of time. The quench severity of a bath cannot be controlled by simply measuring the concentration of the polymer by a method such as refractive index. The rate of heat removal from the metal articles is a function of more than just concentration. Measurements of viscosity of the bath while more accurate than concentration measurements still do not give any clue as to the rate at which heat is conducted away from metal articles in the bath.

SUMMARY OF THE INVENTION

The subject invention provides a method and apparatus for controlling the severity of a heat treating quench bath by maintaining a given molecular weight distribution. In general, this is accomplished by selective filtration and elimination of lower melocular weight constituents and the resulting restoration of the molecular weight balance which is necessary to maintain a quench of the desired severity at a given concentration. A specific example is disclosed of ultrafiltration as a method to achieve this result. This invention may also be carried out on an automatic basis by continuously monitoring the viscosity and refractive index of the aqueous solution of synthetic polymeric quenchant. The viscosity is maintained within preset limits by the addition of water or polymer as needed. The refractive index is maintained within preset limits by the selective filtration.

The apparatus of this invention comprises a quenching bath containing a polymeric quenchant solution in which the low molecular weights of the polymeric quenchant are present in undesirably high proportions. A filtration unit separates the aqueous solution into two streams, one containing a higher proportion and the other a lower proportion of the undesirable lower molecular weights. A pump supplies the motive force to drive the used solution through the filtration unit and recycle it back to the quenching bath. The combination of a continuous viscosity monitor and a continuous refractive index monitor can be used to form an automatic apparatus. The filtration unit can use an ultrafiltration membrane to effect the separation of the solution into two streams.

BRIEF DESCRIPTION OF THE DRAWINGS

FIG. 2 is a schematic diagram of the filtration unit.

FIG. 3 is a graph showing the molecular weight distribution of polymeric quenchants before and after skewing.

DESCRIPTION OF THE SPECIFIC EMBODIMENTS

Figure 1:
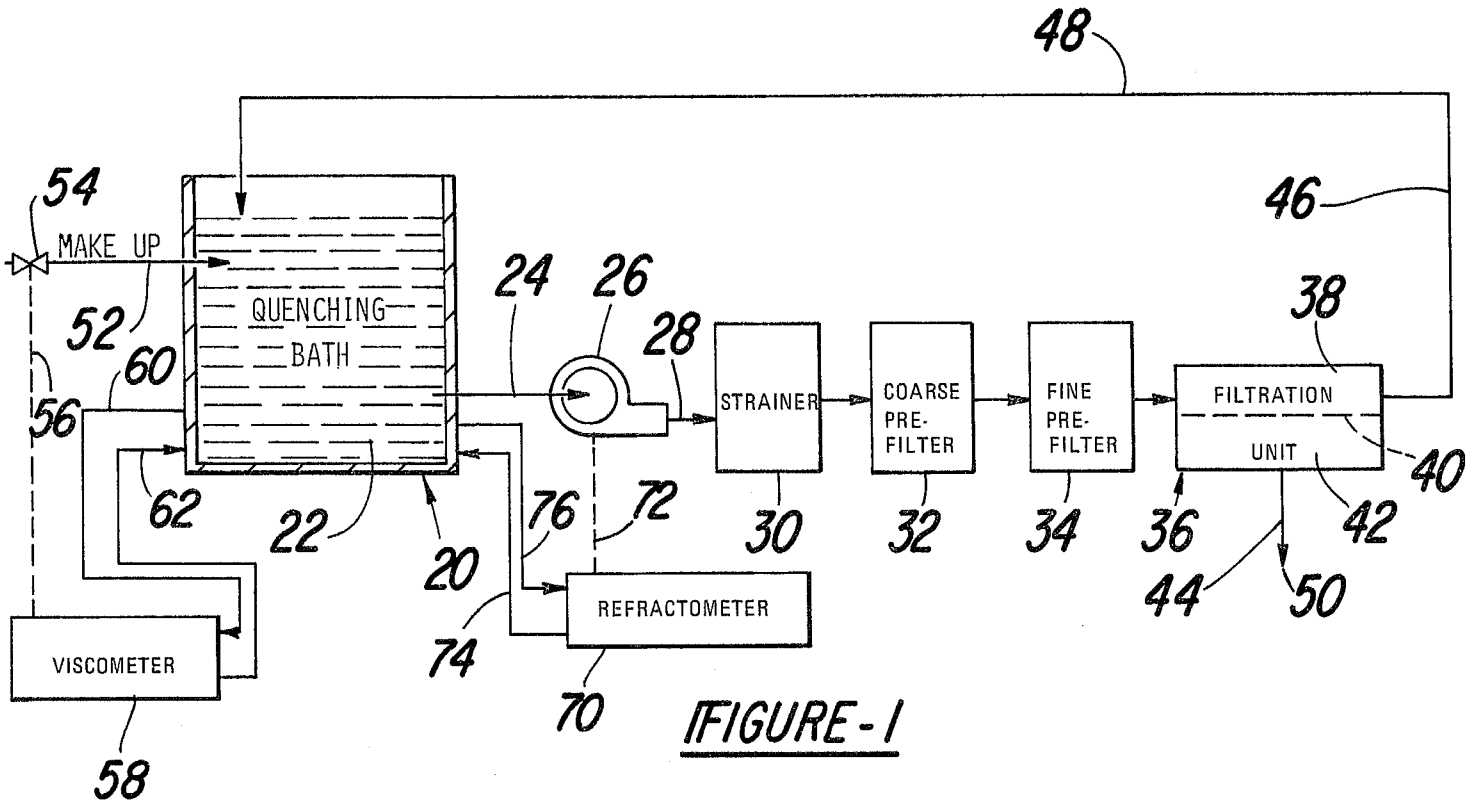
FIG. 1 shows the apparatus and flow diagram for the process of this invention.

FIG. 1 illustrates the invention as applied to a commercial quenching bath 20 containing an aqueous solution of a polymeric quenchant 22 into which hot metal articles (not shown) are immersed for the quenching process. The polymeric quenchant can be for example polyvinyl alcohol, a polyglycol or polyvinyl pyrrollidone. All three of these quenchants are readily available and well known to those skilled in the art.

A typical heat treating process uses an oven or furnace to heat metal articles up to high temperatures. Metal articles are then cooled in a quenching bath. The controlled rate of cooling achievable in a quenching bath imparts highly desirable properties such as hardness to the articles going through the process. After cooling the parts are removed from the quenching bath, rinsed, dried and sent to the user of for further processing steps.

A first conduit means 24 carries the used solution to the pump 26 which provides the hydrostatic pressure and driving force to drive the solution through the pre-filters 30, 32 and 34 and the filtration unit 36. The second conduit means 28 carries the solution to the strainer 30 which is a simple inline pipe strainer well known throughout the chemical process industries. The strainer removes large particles of suspended matter such as scale, woodchips, etc.

The solution then passes through the coarse pre-filter 32 which can be a 100 mesh screen, and the fine pre-filter 34 which take out successively finer particles of suspended matter. Commercially available filters can take out particles down to the size of 25 microns. The exact configuration of the strainer and the two filters is not critical. The three functions can be combined in a single unit if desired. However, this particular configuration minimizes stress and plugging of the filters and lengthens filter life.

The aqueous solution 22 then passes into a filtration unit 36. The filtration unit splits the aqueous solution into two streams; a first stream 50 exits the filtration unit through disposal means 44 and leaves the process. A second stream 46 leaves the filtration unit through return conduit means 48.

Although the invention is disclosed in terms of returning the second stream to the quenching bath there could be two or more containers between which the transfers are made through the filtration unit. The second stream may return to the same bath from which the used solution came, a different quenching bath, or some intermediate vessel. In one embodiment the filtration unit comprises an ultrafiltration unit 36. Ultrafiltration units suitable for use in this process are readily available from Osmonics Incorporated of Hopkins, Minn.

The ultrafiltration unit contains a high pressure compartment 38, a low pressure compartment 42 and the ultrafiltration membrane 40. The pressure of the high pressure compartment reflects the head pressure of the pump 26 minus the line losses going to the ultrafiltration unit 36. This pressure is generally on the order of one to ten atmospheres. The pressure in the low pressure compartment 42 reflects the pressure in the disposal means 44.

The ultrafiltration membrane 40 has a pore size such that low molecular weight ions and organic molecules, and low molecular weight polymer molecules pass through the membrane but the higher molecular weight polymer molecules do not. In a specific example a pore size of 20 K is used. That is, the membrane does not pass a molecule larger than 20,000 molecular weight. This pore size works effectively on an aqueous solution containing polyvinyl pyrrolidone as the polymer.

After a certain residence time in the high pressure compartment 28 the second stream 46 exits the high pressure compartment 38 through the return conduit means 48 and is returned to the quenching bath 20. The first stream 50 after passing through the ultrafiltration membrane 40 accumulates in low pressure compartment 42 and passes through the disposal means 44.

Since a great deal of water passes out with the first stream 50, more water must be added to the second stream 46 to give the appropriate concentration of aqueous polymer in the solution for the quenching bath.

The ultrafiltration unit as well as removing undesirable low molecular weight polymer molecules and other low molecular weight ions frequently removes the rust inhibitors from the aqueous solution. Upon return to the quenching bath the rust inhibitor may be restored to its normal concentration.

FIG. 2 shows a detailed schematic diagram of an ultrafiltration unit. The numbers in this figure represent the same parts as they do in FIG. 1. The ultrafiltration unit 36 is divided into a high pressure compartment 38 and a low pressure compartment 42, separated by the ultrafiltration membrane 40. The ultrafiltration membrane allows low molecular weight polymer molecules 92 through the pores of the membrane, but not the large molecular weight polymer molecules 90. Thus the aqueous solution is divided into two streams. The first stream 50 containing the low molecular weight polymer molecules exit the low pressure compartment at the disposal means 44. The second stream 46 containing the high molecular weight polymer molecules 90 exits the ultrafiltration unit through the return conduit means 48. The larger dots 90 in this diagram represent higher molecular weight species while smaller dots 92 represent lower molecular weight species.

FIG. 3 is a graphic representation of the molecular weight distributions of two aqueous polymeric quenchants. The abscissa 86 represents the molecular weight. Points further to the right represent larger molecular weights. The fraction of molecules falling at a given molecular weight is represented by the ordinate 88. The dashed vertical line 80 represents the average molecular weight described by the curve 82 which represents a desired predetermined normal molecular weight distribution. This bell-shaped curve represents the molecular weight distribution of a fresh polymer as it is purchased. The curve 84 represents the distribution of molecular weights of the polymer after significant use as a quenching bath. It can be seen that the curve has been skewed towards an increase in population of lower molecular weight polymer molecules. These two curves and molecular weight distributions were determined by the gel permeation chromatography method. The filtration process preferably produces a filtrant which is skewed toward higher molecular weights; i.e., having a weight distribution defining a curve which is the mirror image of curve 84 taken about line 80. Thus, the combination of the high-weight filtrant with the low-weight bath tends to restore the original molecular weight balance.

This method of restoring the severity of quenching baths can be practiced either continuously or intermittently. During the normal shut down period for the quenching bath the whole bulk of the solution may be run through the filtration unit. After this process the concentration can then be measured using normal methods and the appropriate quantities of make up water and polymer may then be added.

Maintenance of the quenching bath solution can also be conducted on an automatic or continuous basis. The viscosity and refractive index of the bath are monitored continuously. The apparatus for this mode of operation is shown in FIG. 1.

The viscometer 58 has a stream of the quenching bath solution circulating to it continuously during the operation of the quenching bath. The solution is drawn through the conduit 60 to the viscometer and then exits the viscometer through the conduit 62 back into the bath 20. When the viscosity of the quenching bath solution falls outside preset limits the viscometer actuates a valve 54 through the control circuit 56 and adds either make up water or polymer to the bath through the conduit 52. Controlling the viscosity of the quenching bath limits within a narrow range the rate at which heat can be carried away from metal parts by convection. However, it does not control the rate at which heat is removed by conductivity.

A refractometer 70 continuously monitors the refractive index of the quenching bath solution 22. As the molecular weight distribution of the polymer in the quenching bath becomes skewed, a higher concentration of polymer will be needed to maintain the given viscosity. The refractometer 70 measures this increase in concentration and when it exceeds a preset limit will automatically start the filtration process. Solution is conducted from the quenching bath 20 through conduit means 76 to the refractometer 70 and back to the quenching bath through conduit means 74. As the refractive index exceeds the preset limit, the refractometer signals the start of the pump 26 through the control circuit 72.

Several available viscometers can be used to measure the viscosity in the range needed to control the bath. The range of control will be governed by the concentration, or severity desired and a type of polymer used. Examples of commercially available viscometers are those sold by Nemetre of Addison, N.J. Refractometers are also readily available. As an example the Model 47 process analyzer is available from Anacon Co. Inc. of Ashland, Mass. Other methods of measuring concentration can be used, and would be equivalent to the use of a refractometer. Again the set point for the refractometer will be governed by the type of polymer used and the concentration or quench severity desired in the bath.

The embodiments of the invention in which an exclusive property or privilege is claimed are defined as follows:

1. A method of operating an aqueous polymeric quenching bath so as to maintain a preselected severity comprising the steps of:

(a) establishing a quenching bath containing an aqueous solution of a polymeric quenchant having a predetermined molecular weight distribution and a resulting severity at a given concentration;

(b) utilizing the quenching bath for cooling of heated metal articles thereby skewing the molecular weight distribution of the polymeric quenchant toward a higher population of lower molecular weights with a resulting change in the severity of the quench at the given concentration;

(c) drawing off a portion of the solution and filtering the drawn off portion to eliminate a substantial portion of the lower molecular weights from the drawn off portion until the molecular weight distribution of the filtrant exhibits a higher population of higher molecular weights than the original bath; and (d) returning filtrant to the bath until the original predetermined molecular weight distribution has been substantially achieved.

2. The method defined in claim 1 further including the step of continuously monitoring the refractive index of the bath and initiating the steps of drawing off and returning filtrant when the refractive index exceeds a predetermined value.

* * * * *